US007685983B2

(12) United States Patent
Kuo

(10) Patent No.: US 7,685,983 B2
(45) Date of Patent: Mar. 30, 2010

(54) SYSTEMS AND METHODS OF LUBRICANT DELIVERY

(75) Inventor: Shyang-Lin Kuo, Ann Arbor, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 238 days.

(21) Appl. No.: 11/843,013

(22) Filed: Aug. 22, 2007

(65) Prior Publication Data

US 2009/0050090 A1 Feb. 26, 2009

(51) Int. Cl.
*F01M 1/06* (2006.01)

(52) U.S. Cl. ..... 123/90.34; 123/90.33; 74/567

(58) Field of Classification Search ..... 123/90.34, 123/90.33, 90.6; 184/6; 74/567
See application file for complete search history.

(56) References Cited

U.S. PATENT DOCUMENTS

| | | | | |
|---|---|---|---|---|
| 3,628,513 | A | 12/1971 | Grosseau | |
| 3,782,357 | A | 1/1974 | Kuhn et al. | |
| 4,800,850 | A | 1/1989 | Yoshida et al. | |
| 4,807,574 | A | 2/1989 | Shibata et al. | |
| 4,858,574 | A | 8/1989 | Fukuo et al. | |
| 4,942,855 | A | 7/1990 | Muto | |
| 5,027,762 | A | 7/1991 | Tokuyama et al. | |
| 5,186,129 | A | 2/1993 | Magnan et al. | |
| 6,631,701 | B2 | 10/2003 | Seader et al. | |
| 6,782,856 | B2 | 8/2004 | Aimone | |
| 2001/0038045 | A1* | 11/2001 | Heaslip et al. | 239/590.5 |
| 2003/0155183 | A1* | 8/2003 | Nonaka et al. | 184/6.23 |
| 2004/0163614 | A1 | 8/2004 | Hiyoshi et al. | |
| 2006/0027198 | A1 | 2/2006 | Plenzler et al. | |
| 2006/0260873 | A1 | 11/2006 | Suzuki et al. | |

* cited by examiner

*Primary Examiner*—Zelalem Eshete
(74) *Attorney, Agent, or Firm*—Dinsmore & Shohl LLP

(57) ABSTRACT

Embodiments of a lubricant delivery system comprise a lubricant feeder comprising at least one outlet port with an outwardly tapering cross section, and a lubricant delivery pipe operable to receive lubricant from the at least one outlet port of the lubricant feeder. The lubricant delivery pipe also comprises at least one lubricant discharge nozzle disposed on the lubricant delivery pipe, wherein the at least one lubricant discharge nozzle is operable to deliver lubricant to portions of the lubricant delivery pipe.

18 Claims, 4 Drawing Sheets

SYSTEMS AND METHODS OF LUBRICANT DELIVERY

TECHNICAL FIELD

Embodiments of the present invention are directed to lubricant delivery systems and methods for controlling flow in lubricant delivery systems.

BACKGROUND

Current camshaft oil delivery pipe systems are typically designed based on the need to fit the pipe within the available space inside the head cover rather than the consideration of increasing the lubricating efficiency of the camshaft. The flow of the lubricant within the pipe is driven by the pressure from the lubricant feeder. Current lubricant feeders use an equal amount of lubricant pressure at all inlets of branched camshaft pipes regardless of pipe section bends and lengths. This design creates an uneven lubricant distribution in branched camshaft pipe systems, because outlets near the lubricant feeder often receive too much lubricant and downstream outlets receive not enough lubricant. For camshaft areas downstream of the lubricant feeder to receive proper lubrication, they are dependent upon the oil splash effect from nearby rotating cams. Without proper distribution of lubricant, problems can arise such as increased thermal load, uneven oil drain distribution frictional loss, oil windage loss, oil spill in head gaskets, limited engine performance, and/or limited durability. Accordingly, improved lubricant delivery systems and methods which address one or more of these issues are needed, especially those which can be used for a camshaft assembly.

SUMMARY

According to one embodiment, a lubricant delivery system is provided. The lubricant delivery system comprises a lubricant feeder comprising at least one outlet port, wherein the at least one outlet port comprises a diffuser portion having an outwardly tapering cross section. The lubricant delivery system also comprises a lubricant delivery pipe operable to receive lubricant from the at least one outlet port of the lubricant feeder. Moreover, the lubricant delivery pipe comprises at least one lubricant discharge nozzle disposed on the lubricant delivery pipe, wherein the at least one lubricant discharge nozzle is operable to deliver lubricant to portions of the lubricant delivery pipe.

According to another embodiment of a lubricant delivery system, the lubricant delivery system comprises a lubricant feeder comprising a first outlet port and a second outlet port, and a lubricant delivery pipe operable to receive lubricant from the lubricant feeder. The lubricant delivery pipe comprises a first piping segment coupled to the first outlet port and a second piping segment coupled to the second outlet port. The first outlet port comprises a cross-section having greater flow area than the cross-section of the second outlet port, wherein the diffuser portion of the first outlet port is operable to increase lubricant pressure at the inlet of the first piping segment as compared to the lubricant pressure at the inlet of the second piping segment.

According to yet another embodiment, a method of delivering lubricant is provided. The method comprises the steps of: providing a lubricant feeder comprising at least one outlet port, and a lubricant delivery pipe, wherein the at least one outlet port comprises a diffuser portion having an outwardly tapering cross section; dispensing lubricant from the lubricant feeder through the at least one outlet port; increasing the lubricant pressure at the inlet of the lubricant delivery pipe by passing the dispensed lubricant through the diffuser portion of the at least one outlet port; and delivering lubricant to portions of the lubricant delivery pipe through at least one discharge nozzle disposed on the lubricant discharge pipe.

These and additional objects and advantages provided by the embodiments of the present invention will be more fully understood in view of the following detailed description, in conjunction with the drawings.

BRIEF DESCRIPTION OF THE DRAWINGS

The following detailed description of specific embodiments of the present invention can be best understood when read in conjunction with the drawings enclosed herewith. The drawing sheets include.

Figure 1:
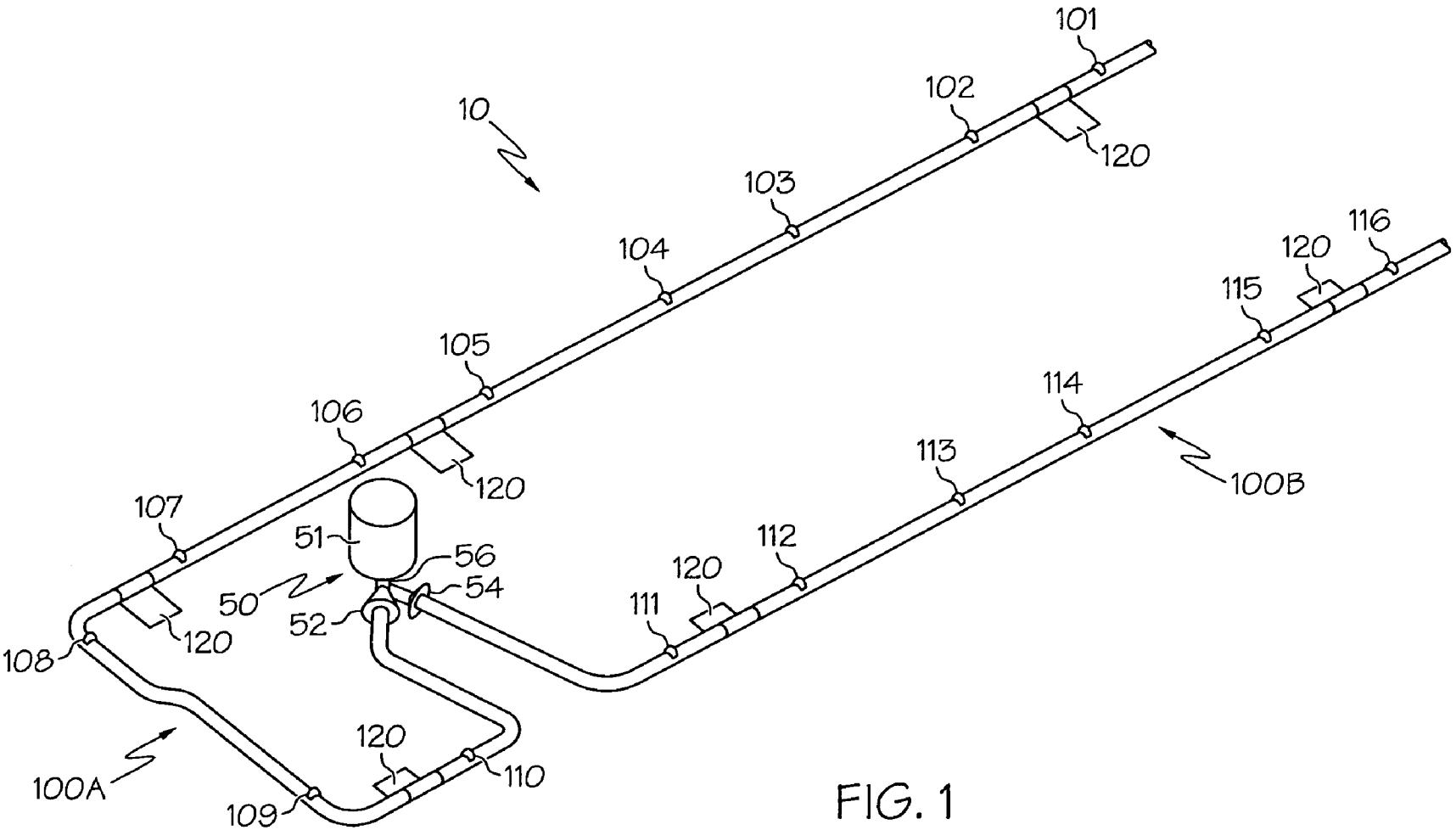
FIG. 1 is a schematic view of a lubricant delivery system comprising an lubricant feeder and a lubricant delivery pipe according to one or more embodiments of the present invention.

The embodiments set forth in the drawings are illustrative in nature and not intended to be limiting of the invention defined by the claims. Moreover, individual features of the drawings and the invention will be more fully apparent and understood in view of the detailed description.

DETAILED DESCRIPTION OF ILLUSTRATED EMBODIMENTS

Referring to FIG. 1, embodiments of the present invention are directed to a lubricant delivery system 10 comprising a lubricant feeder 50 having at least one outlet port 52 (outlet 54 is also shown), and a lubricant delivery pipe comprising at least one piping segment 100A (piping segment 100B is also shown) coupled to the outlet port 52. As discussed later herein, the outlet port 52 is dimensioned to increase the lubricant pressure at the inlet of one or both of the piping segments. By increasing the lubricant pressure at the inlet, the lubricant delivery system 10 ensures increased lubricant delivery at downstream portions of the lubricant delivery pipe, while reducing the amount of lubricant ejected near the lubricant feeder 50. This improves lubricant efficiency, and reduces the problems associated with conventional oil feeders, e.g. increased thermal loads and frictional loss in rotating camshafts. As used herein, "lubricant" refers to conventional motor oils as well as any lubricating fluid known to one of ordinary skill in the art. Although the present application focuses on lubricant delivery in camshaft pipes, one of ordinary skill in the art would recognize the applicability in other industrial lubricating applications.

Figure 2B:
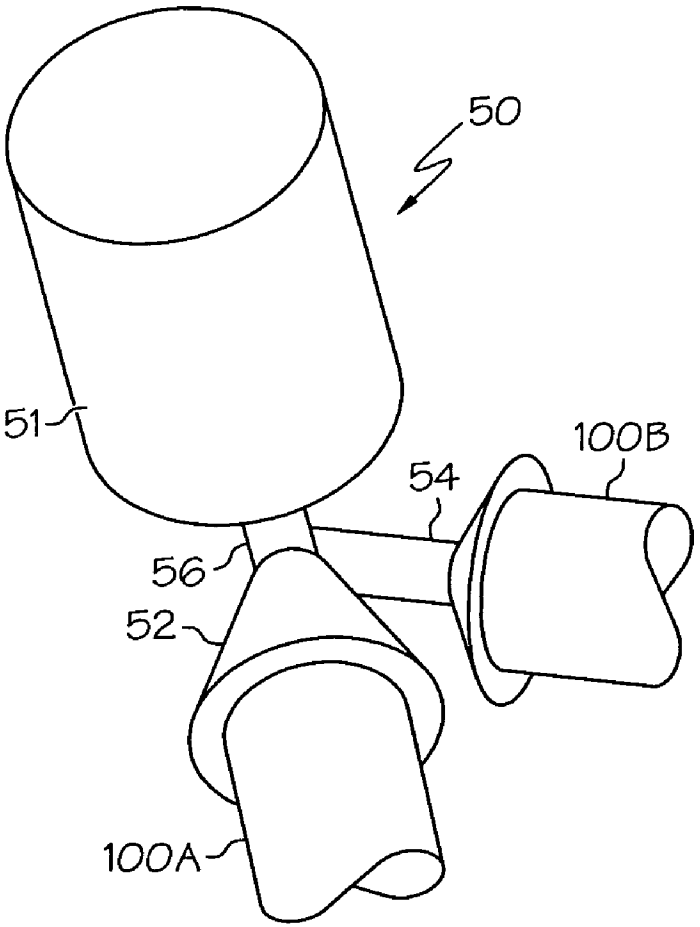
FIG. 2*b* is a schematic view of a lubricant feeder according to one or more embodiments of the present invention.
Figure 2A:
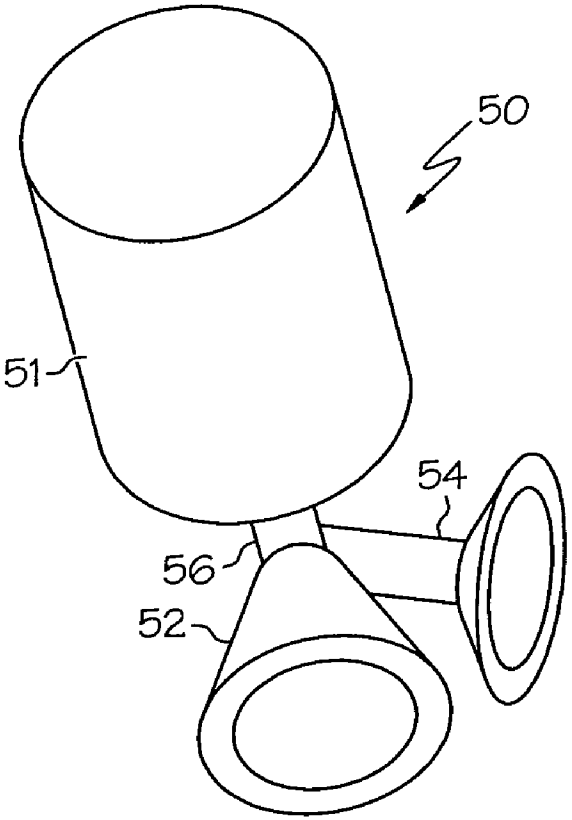
FIG. 2*a* is a schematic view of a lubricant feeder according to one or more embodiments of the present invention.

Referring to an embodiment of the lubricant delivery system 10 as shown in FIGS. 1, 2*a*, and 2*b*, the lubricant feeder 50 may comprise a housing 51 or storage unit configured to store lubricant as well as dispense lubricant through the outlet ports 52 and 54. Referring to FIGS. 2*a* and 2*b*, the lubricant feeder 50 may comprise a cylindrical housing 51; however, other shapes and components suitable for dispensing and storing lubricant are also contemplated herein.

Referring to FIG. 2*b*, the lubricant feeder 50 may comprise a plurality of outlet ports 52, 54 configured to deliver lubricant to the lubricant delivery pipe. The outlet ports 52 and 54 may be mounted directly to the lubricant feeder housing 51 or may be connected to a feed splitter 56 extending from the housing 51. As shown in the embodiment of FIG. 1, the feeder housing 51 is a gravitational feeder that may dispense lubricant through an opening at the lower end of the housing 51. In another embodiment a pump or other apparatus may be utilized to feed lubricant to outlet parts. Referring to the embodiments of FIGS. 2*a* and 2*b*, a first outlet port 52 may comprise a diffuser portion. As used herein, a "diffuser portion" is the region of the outlet port 52, which defines an outwardly tapering cross section. Although the first outlet port 52 is illustrated as a diffuser having an outwardly tapering cross-section, any outlet port shape configured to increase the flow area for a lubricant is contemplated herein. As shown in FIGS. 2*a* and 2*b*, the diffuser portion may extend from the feed splitter 56 towards a piping segment 100A of the lubricant delivery pipe. Referring to FIGS. 2*a*, and 2*b*, the second outlet port 54 defines a constant cross section along a majority of its length spanning between the feed splitter 56 and its connected piping segment 100B of the lubricant delivery pipe, at least with respect to that of first outlet part 52.

The lubricant delivery pipe may comprise one or a plurality of branches or piping segments. Referring to FIG. 1, the lubricant delivery pipe may comprise a first piping segment 100A, and a second piping segment 100B connected to the first outlet port 52 and the second outlet port 54, respectively. The lubricant delivery pipe comprises at least one lubricant discharge nozzle 101-116 disposed on one or more piping segments 100A, 100B of the lubricant delivery pipe. The nozzles 101-116 may comprise pipes or tubes of various shapes disposed on the pipe, wherein each nozzle is configured to spray lubricant onto portions of the lubricant delivery pipe, for example rotating cams. As shown in the embodiment of FIG. 1, the nozzles 101-116 may be arranged at location near the rotating cams for the delivery pipe segments 100*a*, 100B. Fixed at locations 120 in an alternative embodiment, the discharge nozzles may simply constitute holes in the lubricant delivery pipe 100A, 100B in lieu of a pipe or tube structure. For additional information regarding lubricant discharge nozzles and lubricant delivery pipes, U.S. application Ser. No. 11/801,146 has been incorporated herein in its entirety by reference.

As stated above, the first outlet port 52 comprises a diffuser portion, which increases the flow area of lubricant in the first outlet port 52. With increased flow area inside the diffused first outlet port 52, the pressure inside the first outlet port 52 will be larger than the second outlet port 54 having less flow area. According to scientific principles, e.g. Bernoulli's principle regarding fluid dynamics for a subsonic flow, an increase in velocity of the fluid occurs simultaneously with decrease in pressure and flow area of the container. With increased pressure inside the diffuser portion of the first outlet 52, more lubricant will fill the first outlet port 52 than the second outlet port 54. Due to lubricant buildup inside the first outlet port, lubricant pressure will consequently be higher at the inlet of the first piping segment 100A connected to the first outlet port 52 than the inlet of the second piping segment connected 100B to the second outlet port 54, which has lesser flow area.

Referring again to FIG. 1, as pressure-driven lubricant flows through the piping segments 100A and 100B, the discharge nozzles 101-116 will decrease lubricant pressure by ejecting lubricant out of the pipe. As lubricant is released through the discharge nozzles, there is less lubricant remaining in the pipe segments 100A, 100B, and so is less lubricant pressure. Lubricant pressure decreases even further as the lubricant travels further downstream of the lubricant feeder 50 (e.g. see the length of 100A versus 100B). The lubricant feeder 50 accommodates for this pressure decrease by increasing lubricant pressure at the inlet in the first piping segment 100A. Increased lubricant pressure in the piping segment 100A reduces the amount of lubricant released at discharge nozzles from piping segment 100B. Consequently, the present lubricant delivery system 10 ensures that all portions of the lubricant delivery pipe 100 receive adequate lubricant regardless of the length of the piping segment 100A or 100B The lubricant delivery system 10 may also accommodate for factors other than length, which may impede lubricant flow. Referring to FIG. 1, the lubricant delivery pipe 100 may also comprise bends or curves along its length, which may impede the lubricant flow. By increasing lubricant pressure at the inlet of the piping segments, the present lubricant delivery system 10 ensures that pipe bends or curves do not block the lubricant flow to downstream portions of the lubricant delivery pipe.

Figure 3:
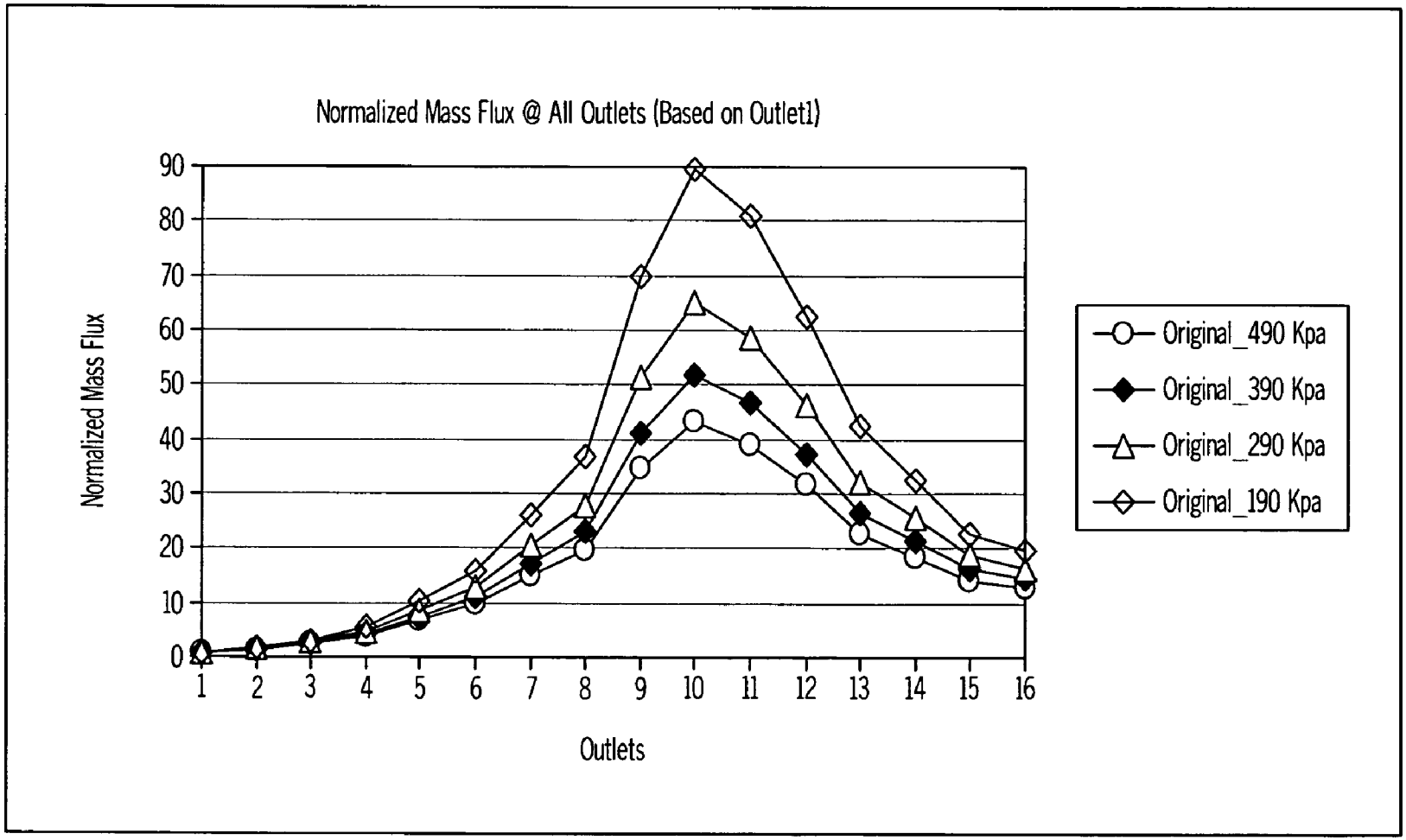
FIG. 3 (PRIOR ART)
FIG. 3 is a prior art graphical view illustrating the normalized mass flux of the lubricant flow at all outlets of the lubricant delivery system for conventional oil feeders.

To demonstrate the improved performance of a lubricant feeder 50 having a diffuser outlet port 52 as shown in FIGS. 1, 2*a* and 2*b* versus conventional lubricant feeders, the following experimental data is provided. As shown, performance is measured by comparing the normalized oil mass flux through all 16 discharge nozzles for a conventional lubricant feeder against the lubricant feeder of the present invention (101-116). Normalized mass flux is obtained by calculating the mass flux of each discharge nozzle (101-116). The mass flux equals the mass flow rate per unit area (g/sec*m$^2$). The mass flux value at each outlet is normalized by dividing each value by the value of the discharge port with the lowest mass flux, e.g., discharge nozzle 101 in the present example. Referring to Table 1 below and FIG. 3, the normalized mass flux across all 16 outlets for the conventional lubricant feeder as shown.

TABLE 1

(Conventional)

| | Pressure | | | |
|---|---|---|---|---|
| Outlets | 490 kpa | 390 kpa | 290 kpa | 190 kpa |
| Outlet 101 | 1.00 | 1.00 | 1.00 | 1.00 |
| Outlet 102 | 1.44 | 1.47 | 1.51 | 1.55 |
| Outlet 103 | 2.63 | 2.77 | 2.95 | 3.18 |
| Outlet 104 | 4.03 | 4.36 | 4.80 | 5.41 |
| Outlet 105 | 6.73 | 7.50 | 8.58 | 10.23 |
| Outlet 106 | 9.75 | 11.03 | 12.88 | 15.89 |
| Outlet 107 | 14.83 | 17.08 | 20.47 | 26.27 |
| Outlet 108 | 19.79 | 23.05 | 28.05 | 36.85 |
| Outlet 109 | 34.80 | 41.24 | 51.34 | 69.73 |
| Outlet 110 | 43.35 | 51.75 | 65.05 | 89.66 |
| Outlet 111 | 39.20 | 46.73 | 58.66 | 80.86 |
| Outlet 112 | 31.65 | 37.36 | 46.29 | 62.61 |
| Outlet 113 | 22.77 | 26.49 | 32.23 | 42.43 |
| Outlet 114 | 18.63 | 21.38 | 25.52 | 32.69 |
| Outlet 115 | 14.30 | 16.08 | 18.66 | 22.88 |
| Outlet 116 | 12.95 | 14.39 | 16.42 | 19.55 |

Figure 4:
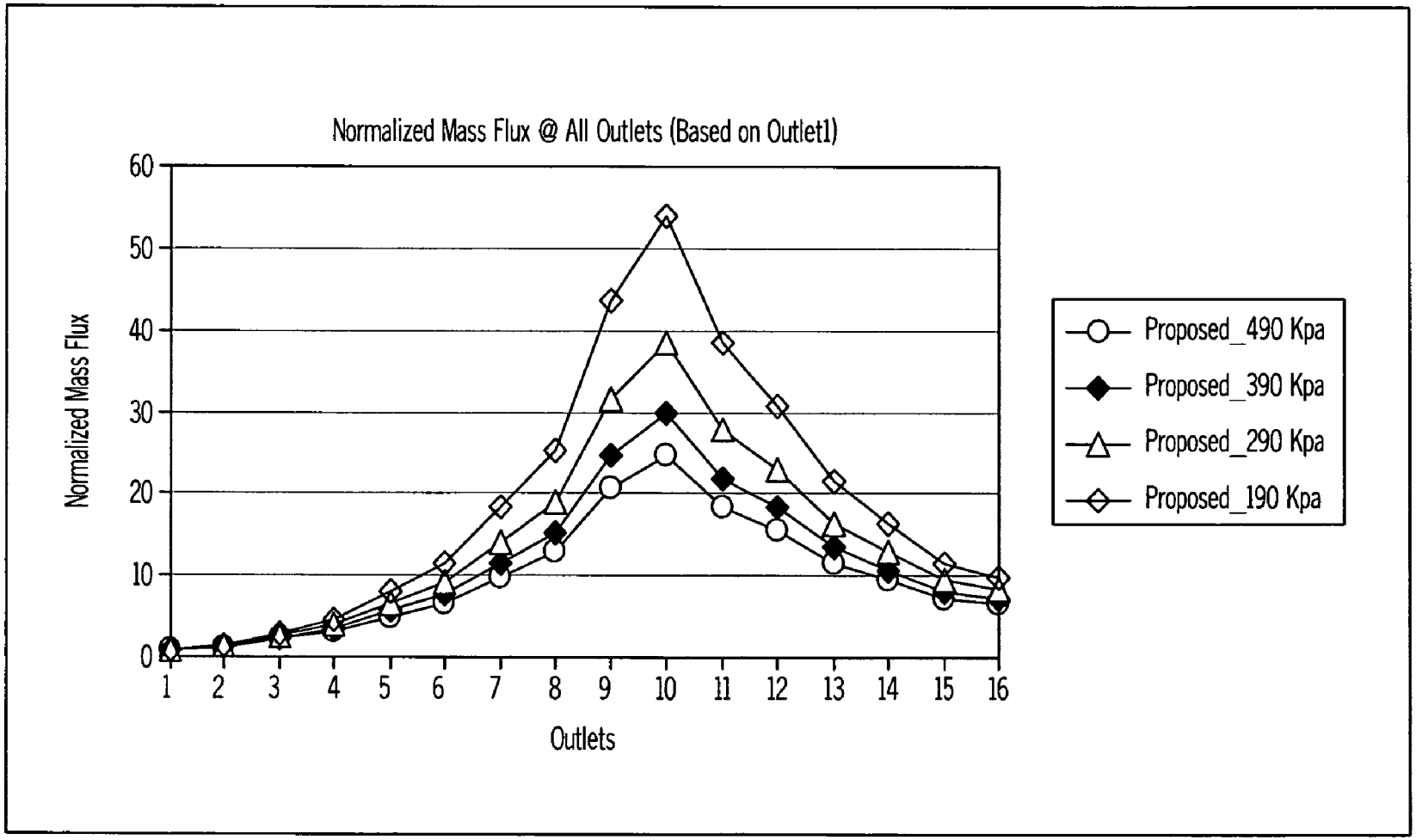
FIG. 4 is a graphical view illustrating the normalized mass flux of the lubricant flow at all outlets of the lubricant delivery system for lubricant feeders as shown in FIGS. 2*a* and 2*b* according to one or more embodiments of the present invention.

Table 2 below and FIG. 4 show the normalized mass flux distribution across all 16 outlets for the lubricant feeder 50 of the present invention.

TABLE 2

| Outlets | Pressure 490 kpa | 390 kpa | 290 kpa | 190 kpa |
|---|---|---|---|---|
| Outlet 101 | 1.00 | 1.0 | 1.0 | 1.0 |
| Outlet 102 | 1.28 | 1.32 | 1.38 | 1.42 |
| Outlet 103 | 2.16 | 2.31 | 2.53 | 2.78 |
| Outlet 104 | 3.14 | 3.43 | 3.90 | 4.50 |
| Outlet 105 | 5.01 | 5.61 | 6.59 | 8.01 |
| Outlet 106 | 6.68 | 7.62 | 9.15 | 11.50 |
| Outlet 107 | 9.89 | 11.47 | 14.09 | 18.33 |
| Outlet 108 | 12.82 | 15.07 | 18.84 | 25.18 |
| Outlet 109 | 20.66 | 24.69 | 31.55 | 43.59 |
| Outlet 110 | 24.77 | 29.81 | 38.47 | 53.95 |
| Outlet 111 | 18.36 | 21.87 | 27.85 | 38.34 |
| Outlet 112 | 15.49 | 18.25 | 22.90 | 30.85 |
| Outlet 113 | 11.56 | 13.38 | 16.41 | 21.39 |
| Outlet 114 | 9.42 | 10.74 | 12.91 | 16.33 |
| Outlet 115 | 7.28 | 8.11 | 9.45 | 11.40 |
| Outlet 116 | 6.58 | 7.24 | 8.27 | 9.67 |

Comparing Tables 1 and 2, it can be easily seen that a diffused outlet port 52 installed to the inlet of the longer branched pipe 100A produces a much smoother lubricant flow across all 16 outlets than those of conventional lubricant feeders. Since lubricant feeders typically operate between 100 kpa and 490 kpa, the above data illustrates that the phenomenon of uneven mass flow distribution is worse in low pressures than in high pressures. Consequently, improving the lubricant efficiency for camshafts operating at low pressures i.e. at low engine speeds or at idle speeds is very important. Table 3 below shows that about 40% improvement in lubricant efficiency can be obtained across the lubricant feeder operating ranges.

TABLE 3

| | Oil Feeder Inlet Pressure 490 Kpa | 390 Kpa | 290 Kpa | 190 Kpa |
|---|---|---|---|---|
| Max. Normalized Mass Flux for Original Design | 43.35 | 51.75 | 65.05 | 89.66 |
| Max. Normalized Mass Flux for Present Design | 24.77 | 29.81 | 38.47 | 53.95 |
| Improvement of Present Design | 42.86% | 42.40% | 40.86% | 39.83% |

By improving the lubricant efficiency, many benefits may be obtained. These benefits may include: better distribution of lubricant oil across the engine camshaft; reduced thermal load for the camshaft areas downstream from the oil feeder; more uniform oil drain distribution inside the engine block; reduced potential for frictional loss in the crankcase, reduced oil windage (agitation) losses; reduced potential for oil spills in the engine head gaskets; and overall improvement of engine performance and durability.

It is noted that terms like "specifically," "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention. It is also noted that terms like "substantially" and "about" are utilized herein to represent the inherent degree of uncertainty that may be attributed to any quantitative comparison, value, measurement, or other representation.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A lubricant delivery system comprising:

a lubricant feeder comprising at least one outlet port, wherein the at least one outlet port comprises a diffuser portion having an outwardly tapering cross section; and a lubricant delivery pipe operable to receive lubricant from the at least one outlet port of the lubricant feeder and comprising at least one lubricant discharge nozzle disposed on the lubricant delivery pipe and downstream from the diffuser portion, the at least one lubricant discharge nozzle being operable to deliver lubricant through a sidewall of the lubricant delivery pipe.

2. A lubricant delivery system according to claim 1 wherein the lubricant feeder is a cylindrical storage housing configured to store oil.

3. A lubricant delivery system according to claim 1 wherein the lubricant delivery pipe comprises bends or curves along its length.

4. A lubricant delivery system according to claim 1 wherein the lubricant delivery pipe is a camshaft pipe.

5. A vehicle comprising a lubricant delivery system according to claim 1.

6. A lubricant delivery system according to claim 1 wherein the lubricant delivery pipe comprises two or more piping segments coupled to the lubricant feeder.

7. A lubricant delivery system according to claim 6 further comprising a feed splitter configured to deliver lubricant to the two or more piping segments.

8. A lubricant delivery system comprising:

a lubricant feeder comprising a storage unit, a first outlet port configured to receive lubricant from the storage unit and a second outlet port configured to receive lubricant from the storage unit in parallel with the first outlet port; and a lubricant delivery pipe operable to receive lubricant from the lubricant feeder and comprising a first piping segment coupled to the first outlet port and a second piping segment coupled to the second outlet port;

wherein the first outlet port comprises a cross-section having greater flow area than the cross-section of the second outlet port, the greater flow area of the first outlet port being operable to increase lubricant pressure at the inlet of the first piping segment as compared to the lubricant pressure at the inlet of the second piping segment.

9. A lubricant delivery system according to claim 8 wherein the first outlet port comprises a diffuser portion having an outwardly tapering cross section.

10. A lubricant delivery system according to claim 8 wherein the lubricant feeder comprises a feed splitter, which connects the lubricant feeder to the first outlet port and the second outlet port.

11. A lubricant delivery system according to claim 8 wherein the second outlet port defines a constant cross section.

12. A lubricant delivery system according to claim 8 wherein the lubricant delivery pipe is a camshaft pipe.

13. A lubricant delivery system according to claim 8 wherein the first piping segment comprises more bends or curves than the second piping segment.

14. A lubricant delivery system according to claim 8 wherein the first piping segment has a longer length than the second piping segment.

15. A vehicle comprising the lubricant delivery system of claim 8.

16. A method of delivering lubricant comprising:

providing a lubricant feeder comprising at least one outlet port, and a lubricant delivery pipe, wherein the at least one outlet port comprises a diffuser portion having an outwardly tapering cross section;

dispensing lubricant from the lubricant feeder through the at least one outlet port;

increasing the lubricant pressure at the inlet of the lubricant delivery pipe by passing the dispensed lubricant through the diffuser portion of the at least one outlet port; and delivering lubricant through a sidewall of the lubricant delivery pipe using at least one discharge nozzle disposed on the lubricant discharge pipe downstream of the diffuser portion.

17. A method according to claim 16 wherein the lubricant delivery pipe is a camshaft pipe.

18. A method according to claim 16 wherein a second outlet port with constant cross-sectional area delivers provides less oil pressure than the outlet port comprising the diffuser.

* * * * *